US011718450B2

(12) United States Patent
Berroa García

(10) Patent No.: US 11,718,450 B2
(45) Date of Patent: Aug. 8, 2023

(54) CAPPING DEVICE INTENDED TO BE FIXED ON THE NECK OF A CONTAINER AND AN ASSEMBLY COMPRISING A CONTAINER AND A CAPPING DEVICE

(71) Applicant: BETAPACK, S.A.U., Irun (ES)

(72) Inventor: Francisco Javier Berroa García, Irun (ES)

(73) Assignee: BETAPACK, S.A.U., Irun (ES)

( * ) Notice: Subject to any disclaimer, the term of this patent is extended or adjusted under 35 U.S.C. 154(b) by 0 days.

(21) Appl. No.: 17/157,931

(22) Filed: Jan. 25, 2021

(65) Prior Publication Data

US 2021/0229873 A1 Jul. 29, 2021

(30) Foreign Application Priority Data

Jan. 24, 2020 (ES) ..... ES202030054
Jan. 24, 2020 (ES) ..... ES202030055
Jan. 24, 2020 (ES) ..... ES202030056
Jan. 24, 2020 (ES) ..... ES202030057

(51) Int. Cl.
*B65D 41/34* (2006.01)
*B65D 55/16* (2006.01)

(52) U.S. Cl.
CPC ..... *B65D 41/3428* (2013.01); *B65D 55/16* (2013.01)

(58) Field of Classification Search
CPC ..... B65D 41/28; B65D 51/18; B65D 43/16; B65D 43/02; B65D 47/06; B65D 39/0047; B65D 39/00; B65D 47/121; B65D 41/3442; B65D 41/3409; B65D 55/16
USPC ..... 215/235, 237; 220/840; 222/556, 546, 222/153.07
See application file for complete search history.

(56) References Cited

U.S. PATENT DOCUMENTS 6,168,035 B1 * 1/2001 McLelland ..... B65D 50/046 215/44
6,382,476 B1 * 5/2002 Randall ..... B65D 47/0885 220/259.2

(Continued)

FOREIGN PATENT DOCUMENTS

EP 1529736 A2 5/2005
ES 2638551 T3 10/2017

(Continued)

*Primary Examiner* — Anthony D Stashick
*Assistant Examiner* — Prince Pal
(74) *Attorney, Agent, or Firm* — Westman, Champlin & Koehler, P.A.

(57) ABSTRACT

The invention refers to a capping device intended to be fixed on a neck (2) of a container including an orifice (3), including the capping device:

a cap (1) which has a helical thread (7) intended to cooperate with a helical thread (6) formed in the neck (2);

a lower ring (9) fixed axially to the neck (2);

a hinge device that connects the cap (1) to the lower ring (9), including the capping device in addition a cap locking device (1) configured to lock the cap (1) in an open tilted position, including such a locking device a bead (22) which is formed, between the two blades (11, 12), and which is configured to rest against the neck (2) of the container when the cap (1) is in the open tilted position, the heel (22) has an internal face where at least one of the ribs of the helical thread series (7) is formed.

17 Claims, 6 Drawing Sheets

(56) References Cited

U.S. PATENT DOCUMENTS

| | | | | |
|---|---|---|---|---|
| 6,474,491 | B1 * | 11/2002 | Benoit-Gonin | B65D 41/3428 220/263 |
| 7,051,888 | B2 * | 5/2006 | Antier | B65D 41/485 220/831 |
| 9,884,706 | B1 * | 2/2018 | Skillin | B65D 41/34 |
| D864,719 | S | 10/2019 | Garcia | |
| 10,654,625 | B2 * | 5/2020 | Migas | B65D 41/3428 |
| D885,895 | S | 6/2020 | Garcia | |
| 10,800,581 | B2 * | 10/2020 | Berroa Garcia | B65D 41/46 |
| 2002/0096532 | A1 * | 7/2002 | Berge | B65D 47/0819 220/831 |
| 2004/0232099 | A1 | 11/2004 | Gardner et al. | |
| 2005/0103740 | A1 * | 5/2005 | Itou | B29C 49/071 215/41 |
| 2011/0114593 | A1 * | 5/2011 | Ishii | B65D 55/16 215/253 |
| 2012/0024815 | A1 * | 2/2012 | Kwon | B65D 41/3409 215/272 |
| 2012/0285921 | A1 * | 11/2012 | Kwon | B65D 55/16 215/243 |
| 2015/0251827 | A1 * | 9/2015 | Campbell | B65D 55/16 215/258 |
| 2019/0119008 | A1 * | 4/2019 | Berroa Garcia | B65D 47/0885 |
| 2020/0180819 | A1 * | 6/2020 | Berroa García | B65D 47/0842 |
| 2020/0207525 | A1 * | 7/2020 | Sung | B65D 47/0871 |
| 2020/0369446 | A1 * | 11/2020 | Mélan-Moutet | B65D 41/3447 |
| 2020/0377268 | A1 * | 12/2020 | Naumann | B65D 50/00 |
| 2020/0399036 | A1 * | 12/2020 | Dai | B65D 41/325 |
| 2021/0070509 | A1 * | 3/2021 | Bevan | B65D 47/0857 |
| 2021/0094733 | A1 * | 4/2021 | Bloom | B65D 41/3442 |
| 2021/0163190 | A1 * | 6/2021 | Berroa Garcia | B65D 47/0838 |
| 2021/0171257 | A1 * | 6/2021 | Melan-Moutet | B65D 41/3428 |
| 2021/0253307 | A1 * | 8/2021 | Druitt | B65D 47/088 |
| 2021/0300648 | A1 * | 9/2021 | Bassi | B65D 41/3428 |
| 2021/0371177 | A1 * | 12/2021 | Berge | B65D 47/0828 |
| 2022/0002021 | A1 * | 1/2022 | Krautkramer | B65D 41/3428 |
| 2022/0055804 | A1 * | 2/2022 | Khattar | B65D 41/3428 |

FOREIGN PATENT DOCUMENTS

| | | | |
|---|---|---|---|
| ES | 1232089 | U | 7/2019 |
| ES | 1236487 | U | 10/2019 |
| WO | 2019110853 | A1 | 6/2019 |
| WO | 2020008092 | A1 | 1/2020 |

* cited by examiner

CAPPING DEVICE INTENDED TO BE FIXED ON THE NECK OF A CONTAINER AND AN ASSEMBLY COMPRISING A CONTAINER AND A CAPPING DEVICE

TECHNICAL FIELD

The invention refers to an assembly comprising a container and a capping device which is equipped with a stopper and enables the stopper to be kept fixed to the neck of a container, thus preventing the stopper from being lost altogether.

Document ES1232089U discloses a capping device which includes a lower ring intended to be fixed axially to the neck of a container, a cap which includes a thread intended to be attached to an additional thread formed in the gland of the container and a joint which joins the cap to the lower ring. The lower ring includes means of attachment intended to retain the lower ring with the gland of the container. The section of the lower ring diameter in which there are means of attachment extends from 25 to 75% of the diameter of the lower ring. The section of the lower ring which is connected to the stopper by the hinge device has no means of attachment which allows that section to rotate between a lowered and a raised position, in particular to allow the stopper to be unscrewed. Moreover, the cap includes ratchet means intended to cooperate with the complementary ratchet means formed in the lower ring and thus allows the cap to be kept in an open tilted position.

This capping device is not completely satisfactory. In particular, this capping device is capable of exhibiting insufficient resistance to pressure, so that the cap is liable to open inadvertently due to too great a pressure in the container, particularly when it is intended to store carbonated drinks.

Indeed, despite the absence of means of attachment to the section of the lower ring that is connected to the cap by the joint, manipulations of the cap to allow the section of the lower ring that is connected to the cap to rotate into a raised position when the cap must be moved from the open tilted position to the closed position are not easy.

SUMMARY

An underlying idea of the invention is to propose a capping device which will enable a cap to be kept attached to the neck of the container which is reliable, easy to make and use.

According to an embodiment, the invention provides a capping device intended to be fixed on the neck of a container including a hole and a coupling collar, including the capping device:

- a cap that includes a top wall and an external peripheral skirt, with the external peripheral skirt having a helical thread formed by a series of ribs and intended to cooperate with a helical thread formed in the neck to allow
- an unscrewing of the neck cap around an X-axis to move the cap from a closing position where the top wall closes the neck hole and the outer peripheral skirt surrounds the neck to a released position where the cap is no longer attached to the neck; and
- a screw on of the cap in the neck to move the cap from the released position to the closed position;
- a lower ring fixed axially to the neck and moving in rotation around the neck along the X axis;

including the capping device in addition a cap locking device configured to lock the cap in the open tilted position, including such a locking device a bead which forms on the outer peripheral skirt, between the two sheets, and which is configured to rest against the neck of the container when the cap is in the open tilted position, the bead having an inner face on which at least one of the ribs of the helical thread series forms.

This allows the improvement of the pressure resistance of the capping device.

Depending on other advantageous embodiments, a capping device of this type may have one or more of the following features.

According to one embodiment, the lower ring includes a first sector comprising coupling elements which project radially into the lower ring and are intended to be arranged under the coupling collar to retain the lower ring axially in the container neck and a second sector, the first sector and the second sector of the lower ring are hinged together in such a way that the second sector rotates with respect to the first sector between a lowered position where the second sector is intended to be arranged under the locking collar and a raised position where the second sector is intended to be arranged at least partially above the locking collar.

The lower ring first sector of the lower ring a front zone which is diametrically opposed to the second sector and two coupling zones which are each arranged between the front zone of the first sector and the second sector, the coupling elements are arranged only in the two coupling zones to allow a radial movement of the lower ring capable of facilitating the passage of a part of the second sector to each side of the coupling collar during the movement of the second sector between the lowered and the released position.

The tensile forces that will be exerted on the lower ring to allow the second sector to move between the lowered and raised position are thus lower, making the capping device easier to use.

Depending on other advantageous embodiments, a capping device of this type may have one or more of the following characteristics.

According to one embodiment, the second sector does not have coupling elements.

According to one embodiment, the front area of the first sector is free of coupling elements.

According to one embodiment, the coupling elements are protrusions that project radially inwards.

Depending on the embodiment, the second sector extends over an angular range of 90 to 150°.

Depending on the embodiment, the front of the second sector extends over an angular range of 90 to 150°.

Depending on the embodiment, each of the two attachment areas extends over an angular range of between 30 and 90°.

According to one embodiment, the capping device comprises a hinge device which joins the cap to the second sector of the lower ring and is configured to allow the cap to rotate between the released position and an open tilted position in which the cap is uncoupled from the neck hole, the hinge device extending over a first angular interval which is cut in two equal parts by a Pb bisector plane;

According to one embodiment, the hinge device is extended over an angular sector that is cut in two equal parts by a Pb bisector plane, the two hinge areas are extended over angular sectors that are symmetrical with respect to the Pb bisector plane.

According to one embodiment, the hinge device extends over an angular sector which is cut in two equal parts by a Pb bisector plane and in which the helical thread formed on the outer peripheral skirt of the cap develops around the X axis according to a first direction and has a lower and an upper end, the lower end of the helical thread being arranged in a second angular interval which is defined between the Pb bisector plane and a radial plane positioned at 160° from the Pb bisector plane according to a second direction opposite to the first direction.

This makes it easier to attach the cap to the neck when moving the cap from the open tilted position to the closed position.

According to one embodiment, the lower end of the helical thread is arranged in an angular sector defined between two radial planes, respectively positioned at 90° and 160° from the Pb bisector plane according to the second rotation direction.

According to one embodiment, the hinging device includes two blades and the capping device also includes a device for locking the cap in the open tilted position, this locking device including a stop which forms on the outer peripheral skirt, between the two blades of the hinging device, and which is configured to rest against the neck of the container when the cap is in the open tilted position, the heel has an inner face on which at least one rib of the helical thread is formed. This improves the pressure resistance of the capping device.

According to one embodiment, the invention also refers to an assembly comprising a container equipped with a neck including a distribution hole, a coupling collar and a helical thread and a capping device mentioned above, the lower ring being fixed axially to the neck and being mobile in rotation on the neck around said X-axis.

According to one embodiment, the first sector of the lower ring includes a front zone which is diametrically opposed to the second sector and two coupling zones which are each arranged between the front zone of the first sector and the second sector. The coupling elements are arranged only in the two coupling zones to allow the radial movement of the lower ring.

Depending on the embodiment, the two attachment areas extend over angular sectors that are symmetrical to each other in relation to the bevel plane Pb.

According to one embodiment, the coupling elements are protrusions that project radially inwards.

Depending on the embodiment, the capping device also includes a locking device configured to lock the cap in the open tilted position, including a stop that projects radially outwards from the cap and is configured to rest against the collar of the neck during movement of the cap from the open tilted position to the position released for use in the second sector, a tensile force that has a component directed radially outwards and a component directed axially upwards to assist the movement of the second sector from the lowered position to the raised position. This makes it even easier to use the capping device, particularly when the cap has to be moved from the open tilted position to the closed position.

According to one embodiment, the stop is configured so that, during movement of the cap from the released position to the open tilted position, the stop rests against an upper end of the second sector of the lower ring to move the second sector from the raised position to the lowered position. This also makes the use of the capping device easier.

Depending on the embodiment, the locking device also includes a bead that is formed on the outer peripheral skirt of the cap and is extended axially, with the heel configured to rest against a helical rib of the helical thread formed in the neck of the container during movement of the cap from the open tilted position to the released position to exert a tensile force on the second sector which has a component directed radially outwards and a component directed axially upwards to assist movement of the second sector from the lowered position to the raised position. This also makes it easier to use the capping device.

Depending on the embodiment, the hinge device includes two blades and the heel is formed between the two blades.

Depending on the embodiment, the stop protrudes radially outwards from the heel.

BRIEF DESCRIPTION OF THE FIGURES

The invention will be better understood and other purposes, details, features and advantages thereof will become more apparent in the following description of several particular embodiments of the invention, provided solely by way of illustration and not limitation, with reference to the attached drawings.

DETAILED DESCRIPTION OF THE EMBODIMENTS

In the description and the figures, the axis X corresponds to the axis of rotation of the cap 1 of the capping device when it is screwed onto the neck 2 of the container. By convention, the "radial" orientation is directed orthogonal to the axis X and the axial orientation is directed parallel to the axis X. The terms "external" and "internal" are used to define the relative position of one element with respect to another, by reference to the X axis, an element close to the axis X is thus classified as internal as opposed to an external element located radially on the periphery.

The terms "upper" and "lower" are used to define the relative position of one element with respect to another by reference to a position in which the orifice 3 of the neck 2 is oriented upwards and the cap 1 is in the closed position on the neck 2 of the container, an element intended to be placed lower being named lower and an element intended to be placed higher being named, upper. The terms "front" and "back" are used to define the relative position of one element with respect to another along a diameter perpendicular to the axis X.

Figure 1:
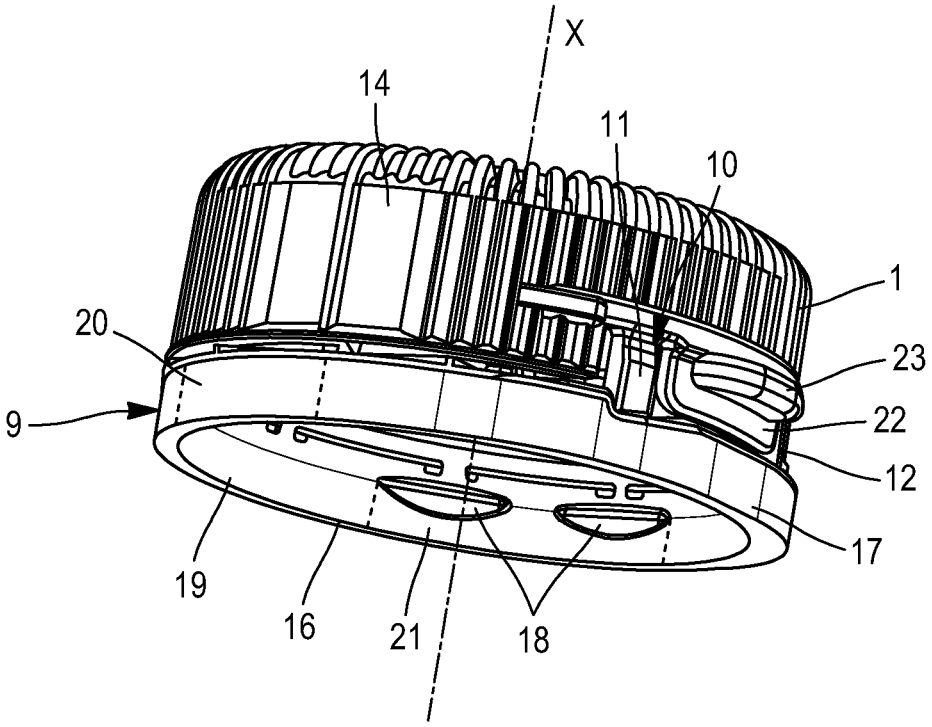
FIG. 1 is a perspective view of three quarters of a capping device.
Figure 2:
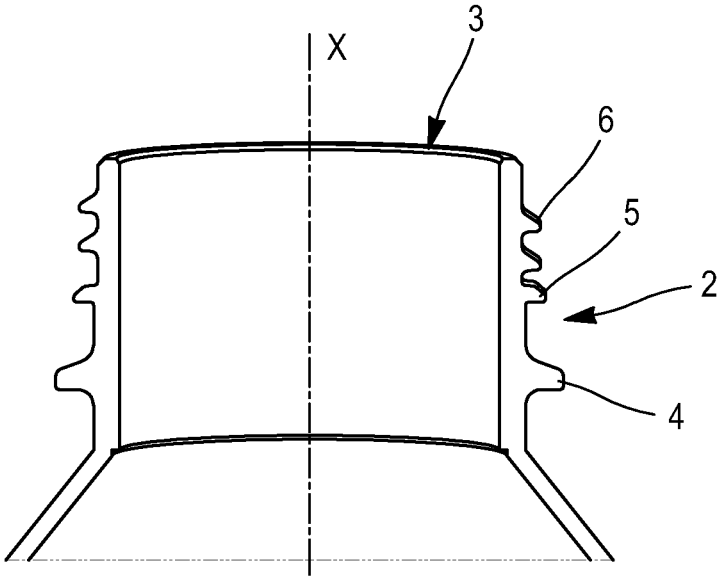
FIG. 2 is a sectional view of a container neck intended to receive the capping device of FIG. 1.

With reference to FIGS. 1 to 10, an assembly comprising a capping device, represented, in particular, in FIG. 1, and a container equipped with a neck 2, represented, in particular, in FIG. 2, are described below.

As shown in FIG. 2, the neck 2 of the container has an upper end on which an orifice 3 is formed that allows the contents of the container to be poured. The neck 2 of the container includes a support collar 4 projecting radially outward and an engaging collar 5 that also projects radially outward and is arranged axially between the support collar 4 and the orifice 3. A cylindrical portion is axially formed between the support collar 4 and the orifice 3. On the other hand, the neck 2 includes, axially positioned between the engaging collar 5 and the orifice 3, a helical thread 6 formed by a series of helical ribs, projecting radially towards the exterior from an external surface of the neck 2. The helical thread 6 is intended to cooperate with a complementary helical thread 7 formed from a series of helical ribs that are formed on the cap 1 of the capping device.

According to one embodiment, the helical thread 6 formed on the neck 2, as well as the helical thread 7 formed on the cap 1 are interrupted. In other words, the adjacent helical ribs are separated by a space that forms a vent and that allows, in particular, to evacuate the gas present inside the container while the cap 1 is still attached to the neck 2.

Figure 4:
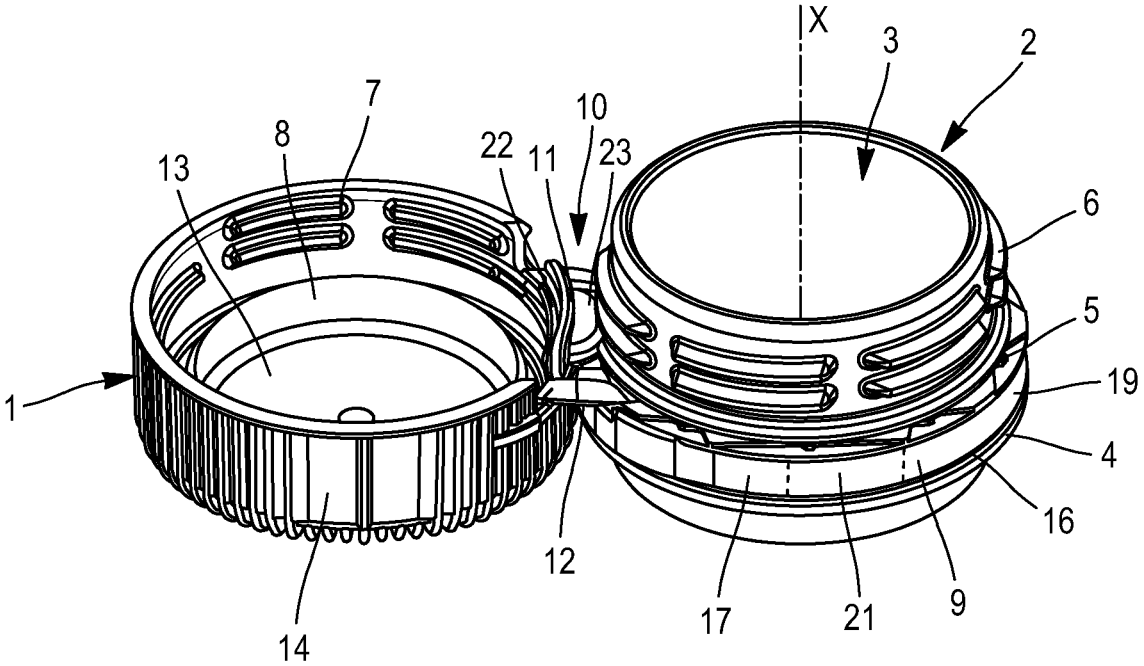
FIG. 4 is a perspective view of the capping device mounted on the neck of the container and showing the cap of the capping device in a tilted open position in which the cap is disengaged from the orifice of the neck.
Figure 9:
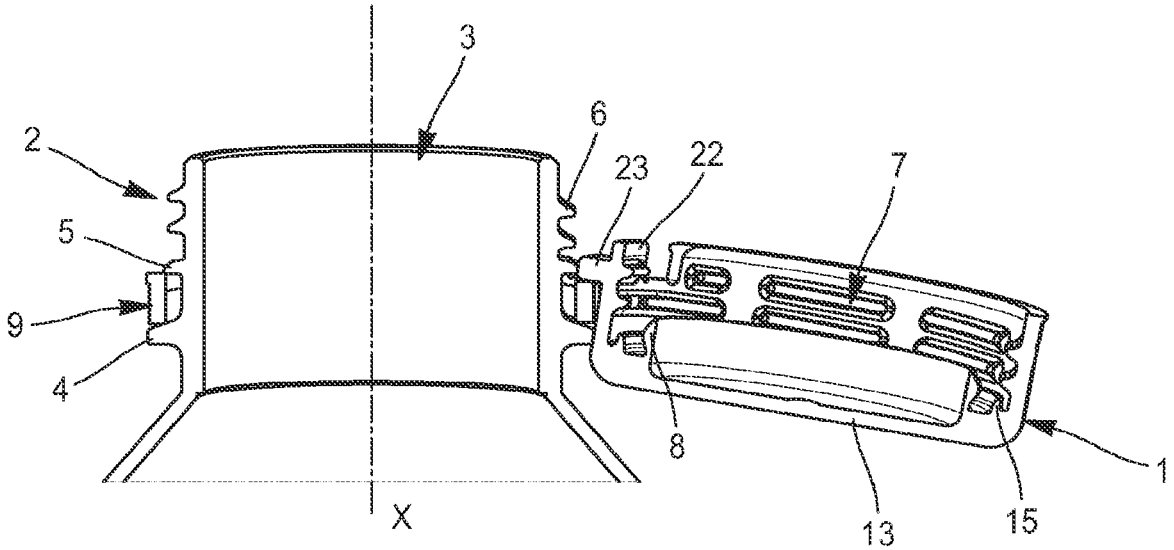
FIG. 9 is a sectional view of the capping device mounted on the neck of the container and showing the cap of the capping device in a tilted open position in which the cap is disengaged from the orifice of the neck.
Figure 11:
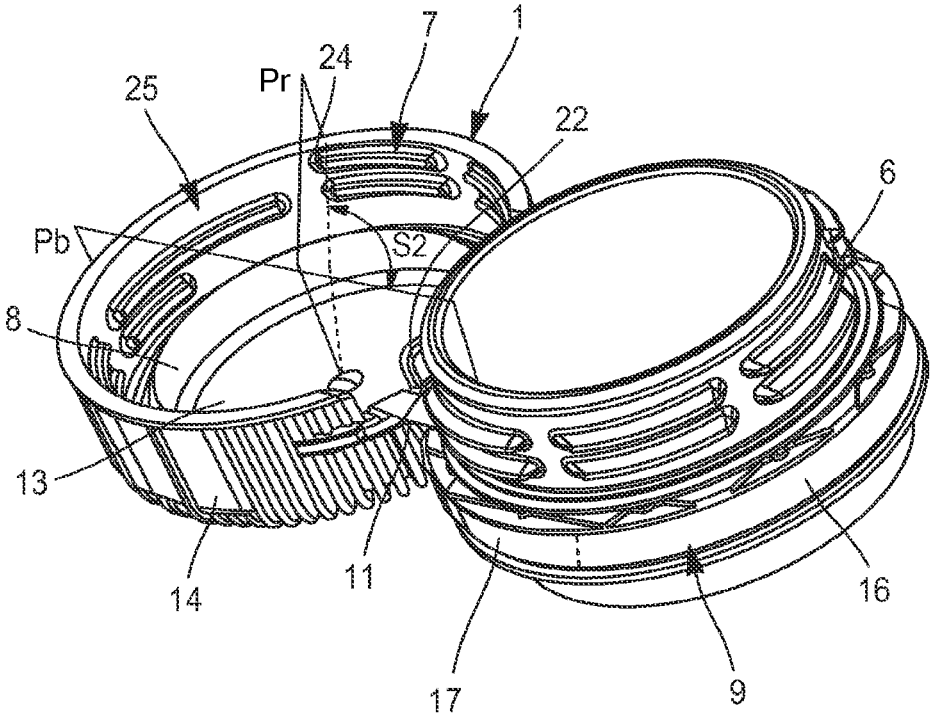
FIG. 11 is a perspective view of the capping device mounted on the neck of the container and showing the cap of the capping device in the tilted open position.

The capping device includes a lower ring 9 that is retained in the neck 2 of the container, a cap 1 that is intended to cover the orifice 3 of the container in order to seal it, a hinge device 10 that joins the cap 1 with the lower ring 9 and a locking device positioned to lock the cap 1 in an tilted open position, shown in FIGS. 4, 9 and 11. In the tilted open position, cap 1 is disengaged from the orifice 3 of the container and does not hinder the pouring of the contents of the container.

Figure 7:
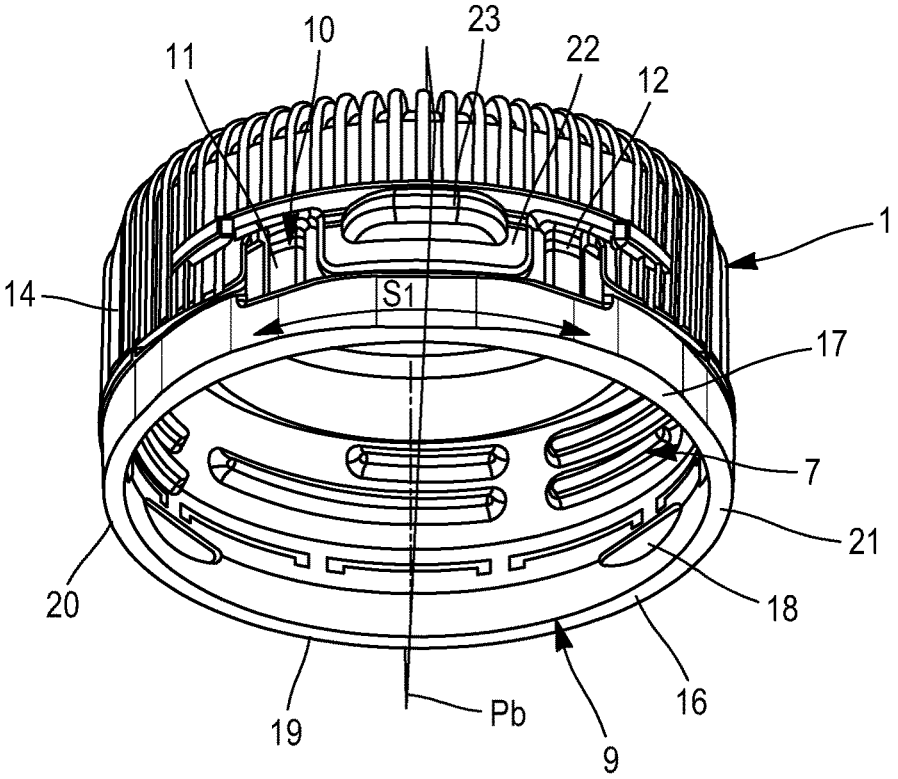
FIG. 7 is a rear perspective view of the capping device.
Figure 8:
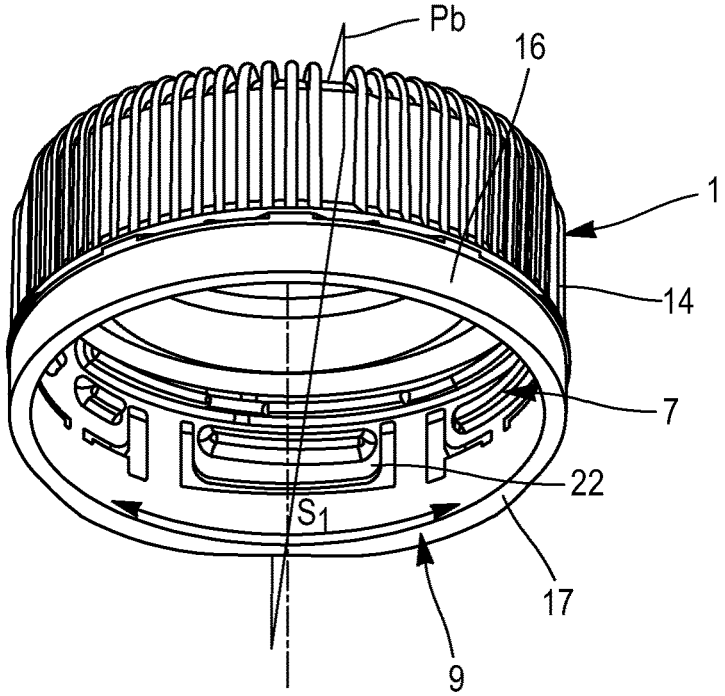
FIG. 8 is a front perspective view of the capping device.

As illustrated in FIGS. 7 and 8, the hinge device 10 extends over an angular range S1 which is intersected in two equal parts by a vertical bisection plane Pb.

Returning to FIG. 1, it is observed that the cap 1 includes an upper wall 13 intended to be arranged substantially and orthogonally to the axis X, opposite the orifice 3 of the neck 2 when said cap 1 is in the closed position. The cap 1 further includes an outer peripheral skirt 14 intended to surround the neck 2 of the container when the cap 1 is in the closed position. The outer peripheral skirt 14 extends, downward, perpendicular to the upper wall 13, from the outer periphery of said upper wall 13.

The outer peripheral skirt 14 has, on its inner face, a helical thread 7, visible in FIGS. 2 and 5 to 7, formed by a series of helical ribs that extend around the axis X in a first direction of rotation. The helical thread 7 is intended to cooperate with the helical thread 6 formed on the external surface of the neck 2. In this way, the cap 1 is able to screw into the neck 2 in order to close the container and to unscrew from the neck 2 in order to open the container. The cap 1 can thus be moved between a closed position and a released position, shown in FIG. 3. In said released position, the cap 1 is no longer engaged with the neck 2. Therefore, it is capable of tilting towards the tilted open position, represented in FIGS. 4, 9 and 11, wherein the cap 1 is disengaged from the orifice 3 of the neck 2 so as not to hinder the pouring of the contents of the container.

As shown in particular in FIG. 9, the cap 1 also includes an internal skirt 8, which extends perpendicularly downward from the upper wall 13 of the cap 1 and is dimensioned to insert into the orifice 3 of the neck 2. The cap 1 also includes an annular lip 15 extending, from the upper wall 13, radially between the inner skirt 8 and the outer peripheral skirt 14. The inner skirt 8 and the annular lip 15 are dimensioned so that, when the cap 1 is in the closed position, in the neck 2 of the container, the inner skirt 8 is in contact against the inner face of the neck 2 while the annular lip 15 is in contact against the outer face of the neck 2. In this way, the internal skirt 8 and the annular lip 15 make it possible to guarantee the sealing of the closure.

Advantageously, the lower ring 9 is, before the first opening of the container, connected to the cap 1 by some frangible bridges, not visible in the figures, intended to be broken during the opening of the cap 1. These frangible bridges thus constitute tamperproof seals.

Figure 3:
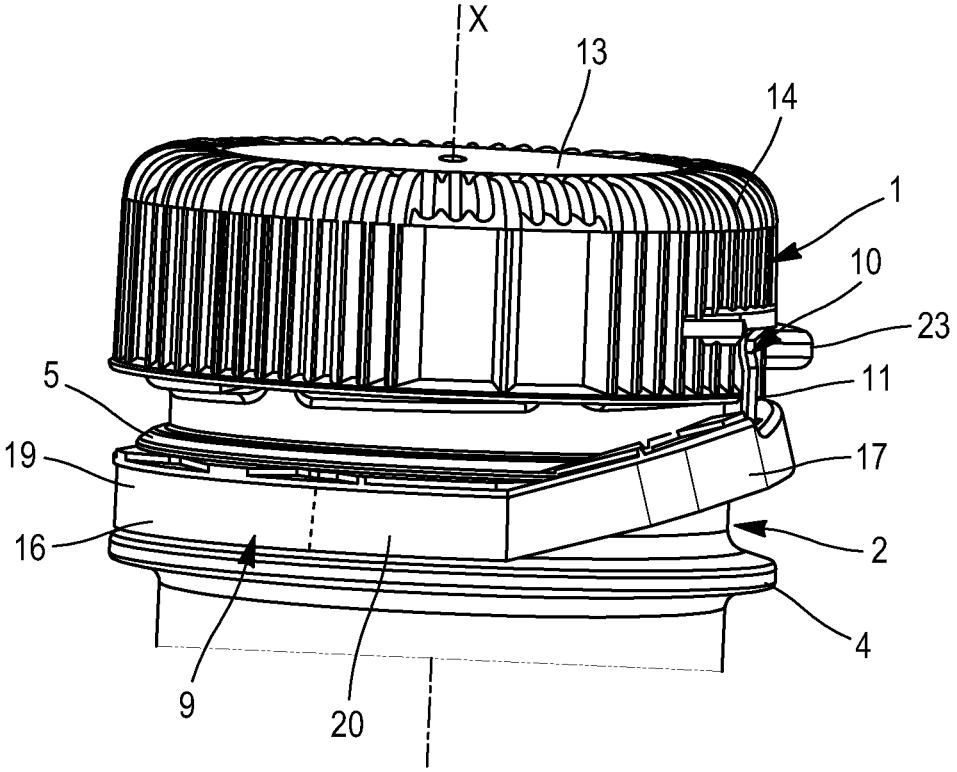
FIG. 3 is a side view of the capping device mounted on the neck of the container and showing the cap of the capping device in a released position in which it is no longer engaged with the neck of the container

The lower ring 9 is held axially on the neck 2 of the container while it can rotate with respect to it about the axis X. As shown in FIG. 3, the lower ring 9 includes two parts that are articulated to each other, that is, a first section 16 and a second section 17 whereby the lower ring 9 is connected to cap 1 by means of the hinge device 10.

According to one embodiment, the lower ring 9 includes two narrowed areas, that is, the radial thickness of which is less than the radial thickness of the lower ring 9 outside of said narrowed areas. The two narrowed areas delimit the first section 16 and the second section 17. The narrowed areas thus form pivots that allow the second section 17 to articulate with respect to the first section 16.

According to another embodiment, the lower ring 9 does not have narrowed areas that delimit the first and second sections 16, 17.

The second section 17 is able to rotate upwards with respect to the first section 16, between a lowered position in which the second section 17 is intended to be arranged under the engaging collar 5 and a raised position, wherein the second section 17 is arranged at least in part above the engaging collar 5. This allows the cap 1 to move upward relative to the neck 2 of the container, until helical thread 7 of cap 1 disengages from the helical thread 6 formed on the neck 2 of the container. In other words, when cap 1 is unscrewed, the lower ring 9 is rotatably driven around the axis X while the second section 17 of the lower ring 9 rotates with respect to first section 16 to the raised position to allow axial movement, up the cap 1, from the closed position, to the released position, represented in FIG. 3. When the cap 1 rotates from the released position to the tilted open position, the second section 17 of the lower ring 9 rotates in the opposite direction with respect to the first section 16 and then returns to the lowered position. On the other hand, as described in more detail below, the second section 17 also rotates relative to the first section 16 from the lowered position to the raised position when the cap 1 rotates from the tilted open position to the released position.

Figure 5:
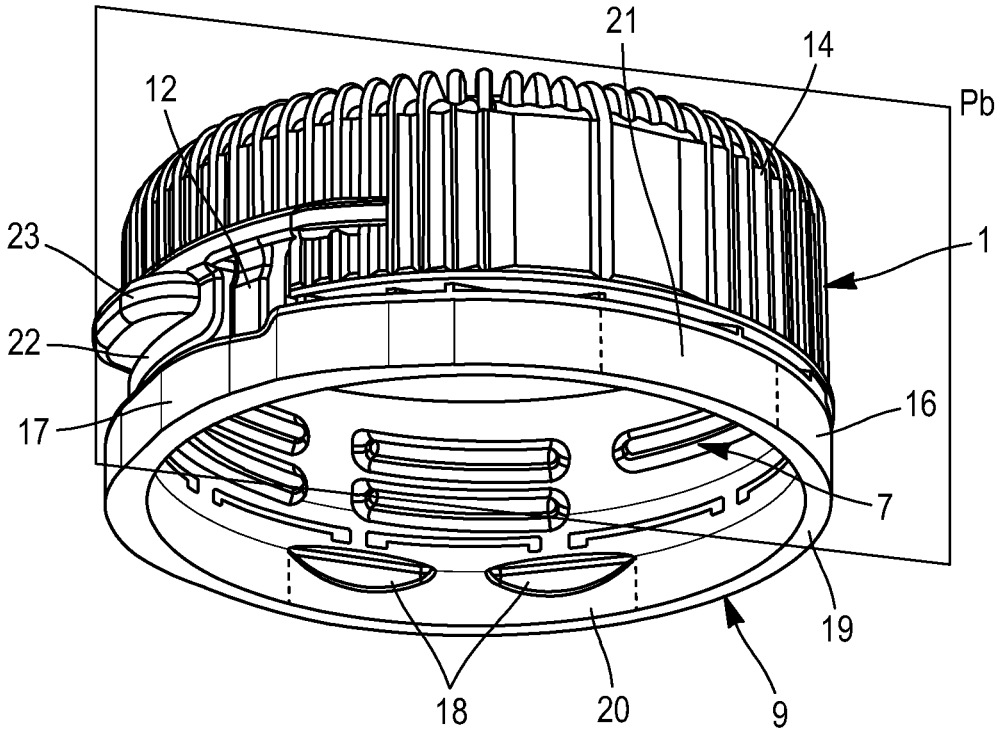
FIG. 5 is a side perspective view of the capping device.
Figure 6:
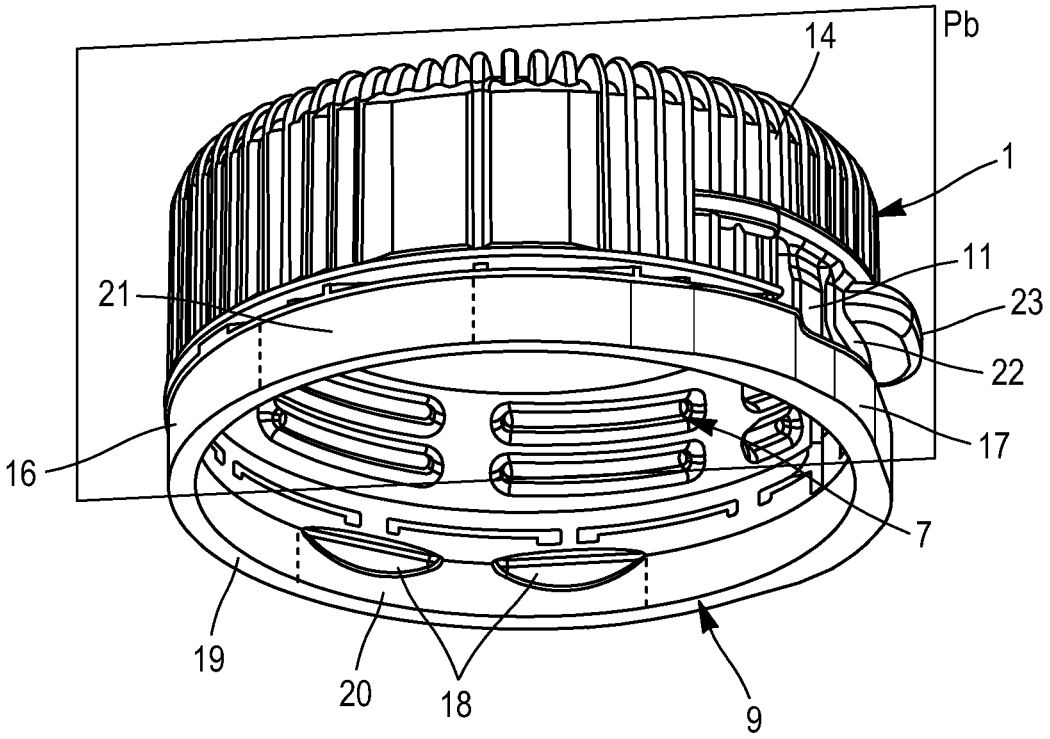
FIG. 6 is another side perspective view of the capping device.

The lower ring 9 is held axially on the neck 2 of the container by means of the engaging collar 5, in particular, visible in FIGS. 5 to 7. The engaging collar 5 presents a frusto-conical external surface that tapers upwards, that is, in direction to the orifice 3 of the container. The engaging collar 5 delimits, downwards, that is, in a direction opposite to the orifice 3, a projection. The first section 16 of the lower ring 9 includes engaging elements 18 that cooperate with the engaging collar 5 formed on the container in order to axially retain the lower ring 9 to the neck 2 of the container. The engaging elements 18 are protrusions, represented in detail in particular in FIGS. 5 and 6, which protrude radially inward from the first section 16 of the lower ring 9. The retaining elements 18 have a radial dimension that increases, from bottom to top, that is to say, in the direction of the upper edge of the lower ring 9. During the assembly of the capping device on the neck 2 of the container, the engaging elements 18 slide against the frusto-conical surface of the engaging collar 5 and then are locked by an elastic return behind the engaging collar 5.

As shown in FIGS. 5 and 6, the first section 16 of the lower ring 9 includes a front area 19 that is diametrically opposite to the second section 17 of the lower ring 9 and two engagement areas 20, 21 that are arranged on each side of the front area 19 and are each arranged between the front area 19 and the second section 17 of the lower ring 9. The engaging elements 18 are only arranged in the two engagement areas 20, 21. Thus, due to the absence of engaging elements 18 in the front area of the first section 16, there is a radial space between the lower ring 9 and the neck 2 that allows the lower ring 9 to move from front to back and vice versa. The radial clearance between the lower ring 9 and the neck 2 in the front/rear direction is, for example, between 0.5 and 1 mm. This facilitates the passage of a part of the second section 17 on either side of the engaging collar 5 during the movement of the second section 17 between the lowered position and the raised position. In other words, the tensile forces that shall be exerted on the lower ring 9 to allow the second section 17 to pass to each side of the engaging collar 5 are less.

Advantageously, the second section 17 extends over an angular range between 90 and 150°, and for example, in the order of 120°, the front area of the second section 16 extends over an angular range between 90 and 150°, for example, in the order of 120°, while each of the two engagement areas 20, 21 extends over an angular range comprised between 30 and 90°, for example, in the order of 60°.

On the other hand, the bisection plane Pb cuts the second section 17 into two equal parts, as well as the front part of the second section 17. The angular ranges corresponding to the two engagement areas 20, 21 are therefore symmetrical with each other with respect to the bisection plane Pb.

The hinge device 10 is configured to allow the cap 1 to rotate between the released position, shown in FIG. 3, wherein the outer peripheral skirt 14 extends downward from the upper wall 13 of the cap 1, and the tilted open position, represented in FIGS. 4, 9 and 11, wherein the outer peripheral skirt 14 extends upwards from the upper wall 13 of the cap 1. In the embodiment shown, the hinge device 10 includes two foils 11, 12, in particular visible in FIG. 4, which join the cap 1 and, more particularly, the outer peripheral skirt 14 of the cap 1 with the lower ring 9, and more particularly, with the second section 17 of the lower ring 9. The two foils 11, 12 are symmetric with respect to the bisection plane Pb.

The locking device includes a heel 22, in particular, visible in FIG. 1, which is formed on the outer peripheral skirt 14 of the cap 1. The heel 22 is arranged between the two foils 11, 12. The lower end of the heel 22 it is advantageously located at the same height as the lower end of the outer peripheral skirt 14. The heel 22 includes a stop 23 which extends circumferentially about the axis X and projects radially outward from the heel 22.

During the movement of the cap 1 from the released position towards the tilted open position, the stop 23 abuts against the upper end of the second section 17 of the lower ring 9 which tends to return said second section 17 towards the lowered position.

Figure 10:
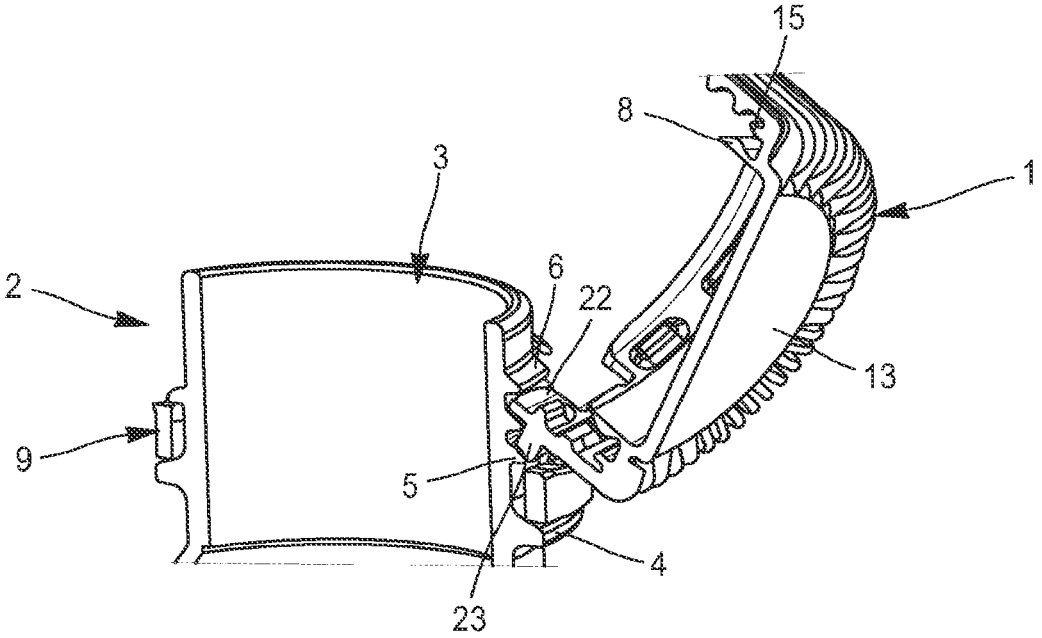
FIG. 10 is a sectional view of the capping device mounted on the neck of the container and showing the cap of the capping device in an intermediate position between the released position and the tilted open position.

On the other hand, during the movement of the cap 1 from the tilted open position towards the released position, at first, the stop 23 rests against the engaging collar 5, as shown in FIG. 10, to exert on the second section 17 of the lower ring 9 a tensile force having a component directed radially outward and a component directed axially upward. This allows the lower ring 9 to be moved from the front to the rear to press the front area 19 of the first section 16 of the lower ring 9 against the neck 2 of the container in order to facilitate the movement of the second section 17 towards the raised position. This also allows aiding the movement of the second section 17 between the lowered position and the raised position.

Then, as shown in FIG. 10, during the movement of the cap 1 from the tilted open position to the released position, the outer surface of the heel 22, comes in a second moment, rests against the upper surface of a helical rib of the helical thread 6 formed in the neck 2 of the container, which also allows to exert on the second section 17 a tensile force having a component directed radially outward and a component directed upward to move the second section 17 towards the raised position.

On the other hand, as shown in FIG. 11, the lower end 24 of the helical thread 7 formed on the inner face of the outer peripheral skirt 14, that is, the beginning of the helical thread 7, is arranged in an angular range S2 which is defined between the bisection plane Pb and a radial plane Pr located at 160° from the bisection plane Pb according to a second direction opposite to the first direction of rotation, that is, in the direction of rotation of the helical thread 7 about the axis X. Thus, a lower front portion 25 of the outer peripheral skirt 14 lacks a helical thread 7, which makes it easier to fit the cap 1 on the neck 2 of the container. This arrangement is particularly advantageous when the cap 1 is capable of being presented in a slightly rearward position when it comes into contact with the neck 2 of the container. This is particularly the case, when the engaging elements 18 are absent from the front area 19 of the first section 16 and that, consequently, the lower ring 9 can move radially from front to back with respect to the neck 2 of the container.

Advantageously, the lower end of the helical thread 7 is arranged in an angular range defined between two radial planes respectively positioned at 90° and 160° from the bisection plane Pb according to a second direction of rotation opposite the direction of the helical thread 7 of the cap 1.

On the other hand, as schematically represented in FIGS. 8, 9 and 10, at least one of the ribs of the series of ribs of the helical thread 7 is formed on the inner face of the heel 22. In other words, at least one of the ribs of the helical thread 7 is formed between the two foils 11, 12 of the hinge device 10. The presence of said rib formed on the heel 22 makes it possible to increase the resistance to pressure of the helical thread 7 and, therefore, prevents cap 1 from opening unintentionally due to excessive pressure on the container, in particular when it is intended to receive carbonated beverages.

The kinematics of the cap 1 is as follows. During the first unscrewing, the cap 1 leaves the closed position and moves away from the lower ring 9 to the released position, illustrated in FIG. 3. The frangible bridges break in the course of this movement. Furthermore, during this unscrewing movement of the cap 1, the lower ring 9 is rotatably driven around the axis X and the second section 17 of the lower ring 9 rotates towards the raised position as the cap 1 moves away from the engaging collar 5.

The cap 1 can then be rotated backwards in the direction of the open tilted position in which the outer peripheral skirt 14 extends upward from the top wall 13. During the movement of the cap 1 back in the direction of its open tilted position, the stop 23 abuts against the upper end of the second section 17 of the lower ring 9, so that the second section 17 of the lower ring 9 rotates from the raised position to the lowered position.

As shown in FIG. 9, when the second section 17 of the lower ring 9 is in the lowered position and the cap 1 is in its tilted open position, the stop 23 is supported against the engaging collar 5. In this way, the cap 1 remains in its tilted open position since, due to this abutment of the stop 23 against the engaging collar 5, the cap 1 cannot rotate towards the released position in which the cap 1 faces the dispensing orifice 3 while the second section 17 of lower ring 9 remains in the lowered position. This makes it possible to increase the minimum opening angle of the cap 1. Thus, advantageously, when the cap 1 is in its tilted open position and the second section 17 of the lower ring 9 is in the lowered position, the opening angle of the cap 1 is greater than 120° and, advantageously, greater than or equal to 145° and, for example, in the order of 180°. The opening angle corresponds to the projecting angular section that is formed at the intersection between a plane parallel to the upper wall 13 of the cap 1 and a horizontal plane.

To close the cap 1 again, the user tilts the cap 1 forward to the released position. During this tilting, the stop 23 rests against the engaging collar 5 to exert on the second section 17 of the lower ring 9 a tensile force that has a component directed radially outward that makes it possible to move the lower ring 9 from front to back and a component directed axially upwards that allows to aid the movement of the second section 17 of the lower ring 9 towards the raised position. The outer surface of the heel 22 also abuts against a helical rib of the helical thread 6 which also facilitates the movement of the second section 17 of the lower ring 9 towards the raised position.

When the second section 17 is in the raised position and the cap 1 is in the released position, the cap 1 can then be screwed back into the neck 2 of the container. During screwing, the lower ring 9 is rotatably driven around the axis X and the second section 17 of the lower ring 9 rotates towards the lowered position as the cap 1 is close to the engaging collar 5.

Advantageously, the entire capping device is molded in a single piece of synthetic material, such as polyethylene and advantageously high-density polyethylene. Advantageously, the capping device is molded in the configuration of FIG. 1, that is, in a closed position, a position in which it can be mounted directly on the neck 2 of the container.

Although the invention has been described in relation to various particular embodiments, it is more than evident that it is not limited in any way by them and that it comprises all the technical equivalents of the means described, as well as their combinations if they fall within the framework of the invention as defined by the claims.

The use of the verb "consist of", "comprise" or "include" and its conjugated forms do not exclude the presence of other elements or stages other than those established in a claim.

In the claims, any reference signs in parentheses are not to be construed as limiting the claim.

The invention claimed is:

1. A capping device intended to be attached to a neck of a container which includes a hole and an engaging collar, the capping device comprising:

a cap which includes an upper wall and an outer peripheral skirt, with the outer peripheral skirt having a thread formed by a series of ribs and intended to cooperate with a thread formed in the neck to allow:

unscrewing of the cap from the neck around an X-axis to move the cap from a closing position where the upper wall closes the hole of the neck and the outer peripheral skirt surrounds the neck to a released position where the cap is no longer attached to the neck, wherein the X-axis defines an axis of rotation of the cap; and screwing of the cap to the neck to move the cap from the released position to the closing position;

a lower ring engageable to the neck and movable in rotation about the neck about the X-axis, wherein the lower ring includes a first sector comprising engaging elements, which project radially into the lower ring and are intended to be arranged under the engaging collar to retain the lower ring axially relative to the neck of the container, and a second sector, the first sector and the second sector of the lower ring are pivotally connected together so that the second sector pivots with respect to the first sector between a lowered position where the second sector is intended to be positioned under the engaging collar and a raised position where the second sector is intended to be at least partially positioned above the engaging collar, such that a bottom surface of the second sector is not in the same plane as a bottom surface of the first sector when the second sector is in the raised position; and a hinge device that connects the cap to the lower ring, the hinge device including two plates that connect the outer peripheral skirt and the lower ring and are arranged to allow the cap to rotate between the released position and an open tilted position in which the cap disengages from the hole of the neck, the capping device in addition including a locking device configured to lock the cap in the open tilted position, such locking device including a bead which is formed on the outer peripheral skirt, between the two plates, and which is configured to rest against the neck of the container when the cap is in the open tilted position, the bead has an internal face where at least one of the ribs of the thread series is formed.

2. The capping device according to claim 1, in which the first sector of the lower ring includes a front zone which is diametrically opposed to the second sector and two coupling zones which are each arranged between the front zone of the first sector and the second sector, the engaging elements are arranged only in the two coupling zones allow a radial movement of the lower ring capable of facilitating the passage of a part of the second sector on each side of the engaging collar during the movement of the second sector between the lowered and the released position.

3. The capping device according to claim 2, in which the coupling engaging elements are protrusions that project radially inwards.

4. The capping device according to claim 1, in which the hinge device extends over a first angular interval that is cut in two equal parts by a Pb bisector plane and in which the thread formed on the outer peripheral skirt of the cap develops around the X-axis according to a first direction and has a lower and an upper end, with the lower end of the thread arranged in a second angular interval which is defined between the Pb bisector plane and a radial plane positioned at 160° from the Pb bisector plane according to a second direction opposite to the first direction.

5. An assembly comprising a container equipped with a neck including a distribution hole, an engaging collar and a helical thread and a capping device according to claim 1, the lower ring being axially retained relative to the neck and movable in rotation about the neck about the X-axis as well as movable radially relative to the neck.

6. The assembly according to claim 5, in which the locking device includes a stop which projects radially outwards from the cap and is configured to rest against the engaging collar of the neck during movement of the cap from the open tilted position to the released position to exert a tensile force on the second sector, the tensile force having a component directed radially outwards and a component directed axially upwards to assist movement of the second sector between the lowered position to the raised position.

7. The assembly according to claim 6, in which the stop configured so that, during movement of the cap from the released position to the open tilted position, the stop rests against an upper end of the second sector of the lower ring to move it from the raised position to the lowered position.

8. The assembly according to claim 6, in which the stop projects radially outwards from the bead.

9. A capping device intended to be retained on a neck of a container that includes an orifice and an engaging collar, including the capping device:

a cap including an upper wall and an outer peripheral skirt, the outer peripheral skirt having a helical thread intended to cooperate with a helical thread to allow:

an unscrewing of the cap around an axis X to move the cap from a closed position in which the upper wall closes the orifice of the neck and the outer peripheral skirt surrounds said neck towards a released position in which the cap is no longer engaged with the neck, wherein the axis X defines an axis of rotation of the cap; and a screwing of the cap to the neck to move the cap from the released position to the closed position;

a lower ring engageable to the neck and rotatably movable on the neck around said axis X, said lower ring including a first section that includes engaging elements that radially project from the lower ring and are intended to be arranged below the engaging collar to axially retain the lower ring on the neck of the container and a second section, the first section and the second section of the lower ring each defining part of a bottom surface of the lower ring and being articulable relative to each other so that the second section can pivot with respect to the first section between a lowered position in which the second section is intended to be arranged below the engaging collar and a raised position in which the second section intended to be arranged at least partially above the engaging collar; and a hinge device that attaches the cap to the second section of the lower ring and is configured to allow the cap to rotate between the released position and an open tilted position in which the cap is released from the orifice of the neck;

the lower ring being configured so that the second section pivots with respect to the first section from the lowered position to the raised position during the movement of the cap from the closed position to the released position and from the raised position to the lowered position during movement of the cap from the released position to the tilted open position, and the first section of the lower ring including a front area that is diametrically opposite to the second section and two engagement areas that are each arranged between the front area of the first section and the second section, the engaging elements being arranged only in the two engagement areas to allow a radial movement of the lower ring capable of facilitating the passage of a part of the second section on each side of the engaging collar during the movement of the second section between the lowered position and the released position.

10. The capping device according to claim 9, wherein the engaging elements are protrusions projecting radially inward.

11. The capping device according to claim 9, wherein the hinge device extends over a first angular range that is cut into two equal parts by a bisection plane Pb, the two engagement areas extending over angular sections that are symmetrical with respect to each other to the bisection plane Pb.

12. The capping device according to claim 9, wherein the hinge device extends over a first angular range that is cut into two equal parts by a bisection plane Pb and wherein the helical thread formed on the outer peripheral skirt of the cap develops around the axis X in a first direction and has a lower end and an upper end, the lower end of the helical thread being arranged in a second angular range defined between the bisection plane Pb and a radial plane positioned at 160° from the bisection plane Pb according to a second direction opposite to the first direction.

13. The capping device according to claim 12, wherein the lower end of the helical thread is arranged in an angular range defined between two radial planes, respectively, positioned at 90° and 160° from the bisection plane Pb according to the second direction of rotation.

14. A capping device intended to be fixed on a neck of a container that includes an orifice and an engaging collar, including the capping device:

a cap including an upper wall and an outer peripheral skirt, the outer peripheral skirt having a helical thread intended to cooperate with a helical thread formed on the neck to allow:

an unscrewing of the cap of the neck around an axis X to move the cap from a closed position in which the upper wall closes the orifice of the neck and the outer peripheral skirt surrounds said neck towards a released position in which the cap is no longer engaged with the neck, wherein the axis X defines an axis of rotation of the cap; and a screwing of the cap the to neck to move the cap from the released position to the closed position;

a lower ring engageable to the neck and rotatably movable on the neck around said axis X, said lower ring including a first section that includes engaging elements that radially project from the lower ring and are intended to be arranged below the engaging collar to axially retain the lower ring on the neck the container, and a second section that has no engaging elements, the first section and the second section of the lower ring being articulable relative to each other so that the second section can pivot with respect to the first section between a lowered position in which the second section is intended to be arranged below the engaging collar and a raised position in which the second section is intended to be arranged at least partially above the engaging collar; and a hinge device that attaches the cap to the second section of the lower ring and is configured to allow the cap to rotate between the released position and an open tilted position in which the cap is disengaged from the orifice of the neck, the hinge device extends over a first angular range which is cut into two equal parts by a bisection plane Pb, the lower ring being able to move radially from front to back to facilitate the passage of a part of the second section on each side of the engaging collar during the movement of the second section between the lowered position and the released position, and the helical thread developing around the axis X according to a first direction and having a lower end and an upper end, the lower end of the helical thread being arranged in a second angular range defined between the bisection plane Pb and a radial plane positioned at 160° from the bisection plane Pb according to a second direction opposite to the first direction.

15. The capping device according to claim 14, wherein the first section of the lower ring includes a front area that is diametrically opposite to the second section and two engagement areas which are each arranged between the front area of the first section and the second section, the engaging elements being arranged only in the two engagement areas to allow radial movement of the lower ring.

16. The capping device according to claim 15, wherein the capping device further includes a locking device configured to lock the cap the tilted open position, said locking device including a stop radially projecting outward of the cap and is configured to rest against the engaging collar of the neck during the movement of the cap from the tilted open position towards the released position to exert on the second section a tensile force having a component directed radially outward and a component directed axially upward to aid the movement of the second section between the lowered position to the raised position.

17. The capping device according to claim 16, wherein the locking device further includes a heel that is formed on the outer peripheral skirt of the cap and extends axially, the heel being configured so that it rests against a helical rib of the helical thread formed on the neck of the container during the movement of the cap from the tilted open position towards the released position to exert on the second section a tensile force having a component directed radially outward and a component directed axially upward to aid movement of the second section from the lowered position to the raised position.

* * * * *